United States Patent [19]

Tomioka et al.

[11] Patent Number: 4,545,741

[45] Date of Patent: Oct. 8, 1985

[54] VERTICAL MOTOR PUMP

[75] Inventors: Shunzoo Tomioka; Masaaki Nakano; Kinpei Okano; Kousaku Shimizu, all of Hitachi; Hiroaki Yoda, Ibaraki, all of Japan

[73] Assignee: Hitachi, Ltd., Tokyo, Japan

[21] Appl. No.: 492,641

[22] Filed: May 9, 1983

[30] Foreign Application Priority Data

May 7, 1982 [JP] Japan ..... 57-75427

[51] Int. Cl.[4] ..... F04B 39/02; F01D 25/16

[52] U.S. Cl. ..... 417/365; 417/369; 417/372; 417/424; 415/112; 384/101; 384/111; 384/286

[58] Field of Search ..... 417/372, 366, 369, 365, 417/424; 384/101, 102, 111, 118, 286, 107, 108; 415/110, 111, 112

[56] References Cited

U.S. PATENT DOCUMENTS

| | | | |
|---|---|---|---|
| 3,123,338 | 3/1964 | Borden | 415/112 |
| 3,143,381 | 8/1964 | Vurpillot | 384/111 |
| 3,332,726 | 7/1967 | Cooper | 384/101 |
| 3,652,186 | 3/1972 | Carter | 417/424 |
| 3,694,110 | 9/1972 | Guinard | 417/424 |

FOREIGN PATENT DOCUMENTS

| | | | |
|---|---|---|---|
| 140587 | 9/1949 | Australia | 415/112 |
| 1928784 | 8/1979 | Fed. Rep. of Germany | 415/111 |
| 1239017 | 7/1960 | France | 415/112 |
| 142995 | 7/1980 | Japan | 415/111 |

*Primary Examiner*—Cornelius J. Husar
*Assistant Examiner*—Peter M. Cuomo
*Attorney, Agent, or Firm*—Antonelli, Terry & Wands

[57] ABSTRACT

A vertical motor pump including an upper bearing and a lower bearing located on the motor side for journaling a rotary shaft for rotation at an upper portion and a lower portion respectively of a rotor, at least one of the upper and lower bearings being constituted by a ball bearing. The vertical motor pump further includes a hydrostatic lubricated bearing system for journaling the rotary shaft besides the ball bearing, for bearing a radial thrust during operation.

2 Claims, 4 Drawing Figures

VERTICAL MOTOR PUMP

BACKGROUND OF THE INVENTION

1. Field of the Invention

This invention relates to vertical motor pumps, and, more particularly to a vertical motor pump suitable for use as an electric pump of a submerged type for pumping up a liquid of low viscosity, such as a cryogenic liquid.

2. Description of the Prior Art

Generally, a vertical motor pump, such as a vertical submerged pump for handling a liquid of low viscosity, such as water, a cryogenic liquid, etc., has main bearings in the form of ball bearings formed of a corrosion resistant metal.

The ball bearings of this type are constructed such that they are lubricated by a liquid of low viscosity, so that they could not be expected to have a prolonged service life under high load as is the case with ball bearings of an oil lubricated type. Thus, various measures have been taken to prolong their service life. A ball bearing usually comprises an inner race, an outer race and ball bearing elements, all formed of corrosion resistant metal. When a ball bearing is intended for use with equipment in which lubrication with a liquid of low viscosity is inevitable, the following lubrication techniques are used. A cage is formed of special resinous material provided by reinforcing expensive tetrafluoroethylene resin with glass fibers and mixing a self-lubricating agent, such as molybdenum disulfide ($MoS_2$) powder with the resin. When the cage of this type is used, the $MoS_2$ is transferred to the balls and adheres thereto as the balls are brought into contact with the cage during operation, to thereby achieve lubrication. However, even if this system is used, it would be difficult to prolong the service life of the ball bearings as one might wish. Thus, attempts have been made to adopt a load reducing system which is intended to reduce a load applied to the bearings to prolong their service life. A vertical motor pump provided with this load reducing system comprises a casing plate placed on an upper flange of an outer casing, and an inner casing located at the casing plate. The inner casing has secured to its interior a stator including a stator core and a stator coil, and a rotor including a rotor core and a rotor coil is arranged in predetermined spaced relation to the stator, to provide a motor section. Pump members, such as an impeller, are located in a position below the motor section. The rotor of the motor section and the impeller or a pump member are connected together by a rotary shaft for rotation therewith. The rotary shaft is journaled at its motor end by two ball bearings located one above the other and at its pump end by a radial bearing located at a lower end of the rotary shaft. A thrust load reducing system in the form of a rotary ram referred to hereinabove is mounted midway between the motor section and the pump section, to keep a pump thrust generated during pump operation from being directly applied to the ball bearings as a load.

Operation of the motor pump of the aforesaid construction of the prior art will be described. Energization of the stator starts the rotor so that the rotary shaft fitted to the rotor and the impeller attached to a lower portion of the rotary shaft begin to rotate. Rotation of the impeller causes a liquid on the suction side to flow into the impeller blades and has its pressure raised by the impeller arranged in a plurality of stages before flowing into a discharge passage extending behind the stator and reaching a channel from which it is transferred to an external conduit. In this process, lubrication of the bearings supporting the rotor is effected by the liquid having its pressure raised by the impeller. The lubrication of the ball bearings located one above the other on the motor side will first be described. A portion of the pressurized liquid flows into a gap in the rotary ram of the load reducing system from a chamber before the majority of the pressurized liquid flows into the discharge passage. At this time, an upwardly oriented thrust is produced in the rotary ram by the raised pressure of the liquid while a thrust is produced in the pump by the impeller back pressure. These two thrusts cancel each other out, thereby achieving the effect of reducing a load applied to the lower ball bearing. The liquid flowing out of the gap in the rotary ram is introduced into the lower ball bearing and flows into a gap between the stator and the rotor while lubricating the ball bearing, to effect cooling of portions heated by a current passed thereto. Then the liquid lubricates the ball bearing located at an upper end of the rotary shaft and gathers together in an overflow pipe before being returned to the suction side (in this case the liquid may flow through a heat exchanger before being returned to the suction side). Let us now study the behavior of the rotary ram during a transitional period of operation. When the pump is inoperative, it moves downwardly to a lowermost position due to the weight of the rotor. When the pump starts operation, the rotary ram is moved upwardly by the pressurized liquid and the rotary shaft fitted thereto begins to shift, and the upper and lower ball bearings also shift by following suit.

The load reducing system thus has the effect of causing the upper and lower ball bearings to quickly follow up the vertical movement of the rotary shaft to avoid occurrence of abnormal conditions in the ball bearings (inordinate wear or seizure caused by unbalanced movement or lopsided loading), so that it is possible to prolong the service life of the ball bearings. However, an increase in the capacity of pumps successively increases a load applied to the pumps. The load reducing system would be able to cope with an increase in the thrust applied to the pumps if its specifications were altered. However, if the equipment were high in head, the circumference of an inner chamber of an impeller housing might become unbalanced hydrodynamically, to thereby generate a force which would act as a radial thrust on the bearings. Production of this force is governed to a great extent by the degree of precision with which the impeller housing, flow regulating plate and impeller blades are fabricated, and the direction in which the force acts as a load is not constant. Thus, it is impossible to absorb the force by the load reducing system. The result of this is that the lower ball bearing most suceptible to a radial thrust would have its service life shortened.

Generally, calculation of the service life of a ball bearing is done by using equation (1) set forth below. To achieve a prolongation of the service life, it is considered effective either to minimize the value of the working load P or increase the capacity of the basic rated load C in equation (1). However, the capacity of the basic rated load C would be decided upon when decisions are made on the model and dimensions, and a reduction in the working load P would be the last available means for prolonging the service life. This last available means could not be used when it is impossible, as described hereinabove, to reduce the load. Thus it would be impossible to obtain a prolongation of the service life.

$$L=K\cdot(C/P)^3 \quad (1)$$

where:
L: service life;
K: coefficient of lubrication
C: basic rated load
P: working load.

SUMMARY OF THE INVENTION

This invention has been developed for the purpose of obviating the aforesaid disadvantages of the prior art. Accordingly, the invention has as its object the provision of a vertical motor pump capable of withstanding a load that might be applied radially thereto, thereby enabling a prolongation of its service life to be achieved.

In accordance with the invention, at least one of an upper bearing and a lower bearing on the side of a motor for rotatingly journaling a rotary shaft in an upper portion and a lower portion, respectively, of a rotor is constituted by a ball bearing, and the rotary shaft is journaled, besides being journaled by the ball bearing, by a hydrostatic lubricated bearing system which bears a load applied radially to the rotary shaft during its operation.

DESCRIPTION OF THE PREFERRED EMBODIMENTS

The invention will now be described in detail by referring to the embodiments shown in the accompanying drawings.

Figure 1:
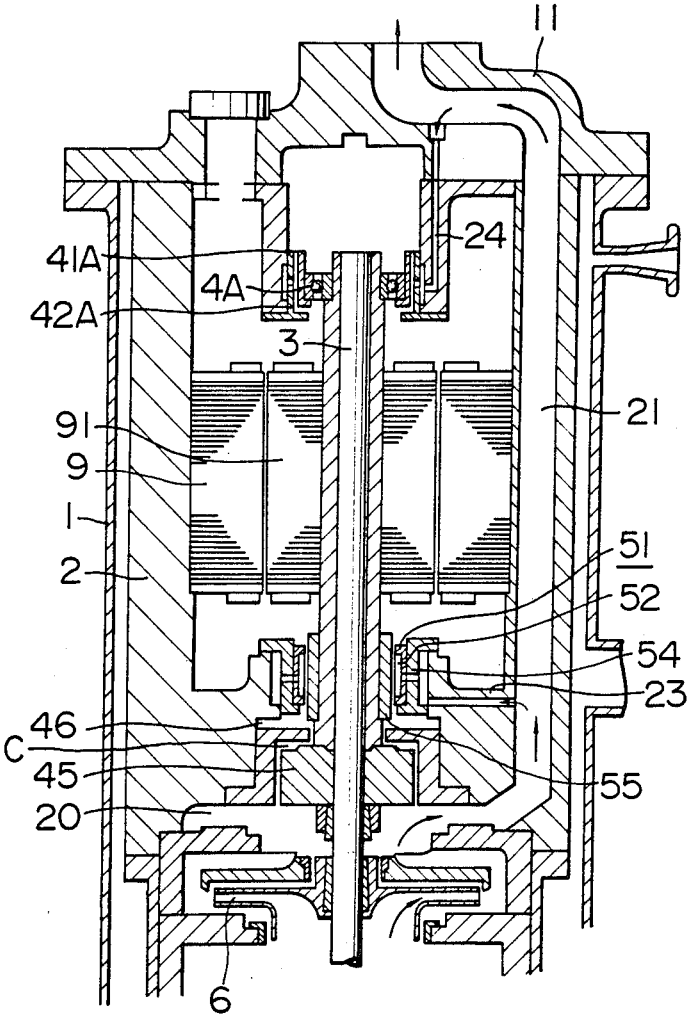
FIG. 1 is a sectional view of the vertical motor pump comprising one embodiment of the invention.

Referring to FIG. 1, a vertical motor pump such as, for example, a submerged pump includes an outer casing 1 having a casing plate 11 placed on an upper flange, and an inner casing 2 to the casing plate 11. Secured in the inner casing 2 is a stator 9 comprising a stator core and a stator winding which is spaced apart a predetermined distance from a rotor 91 comprising a rotor core and a rotor winding, so that the stator 9 and the rotor 91 constitute a motor section. An impeller 6 and other pump parts are located below the motor section. The rotor 91 of the motor section is connected to a rotary shaft 3 together with the impeller 6, for rotation with the rotary shaft 3.

In the embodiment of FIG. 1, an upper bearing on the motor side is constituted by a ball bearing 4A for journaling the rotary shaft 3, and a hydrostatic lubricated bearing system 51 is provided to serve as a lower bearing for journaling the rotary shaft 3 which is intended to bear a load applied radially to the rotary shaft 3 during its rotation. The hydrostatic lubricated bearing system 51 comprises a hydrostatic lubricated pocket 52 arranged in a manner to enclose a rotary sleeve 55 mounted on a portion of an outer periphery of the rotary shaft 3 with a predetermined clearance between the rotary sleeve 55 and the hydrostatic lubricated pocket 52, and a bearing case 54 secured to the inner casing 2 for containing the hydrostatic lubricated pocket 52 therein. The hydrostatic lubricated pocket 52 includes a pocket portion for forming a film of pressurized lubricating liquid on the outer side of rotary sleeve 55.

Figure 3:
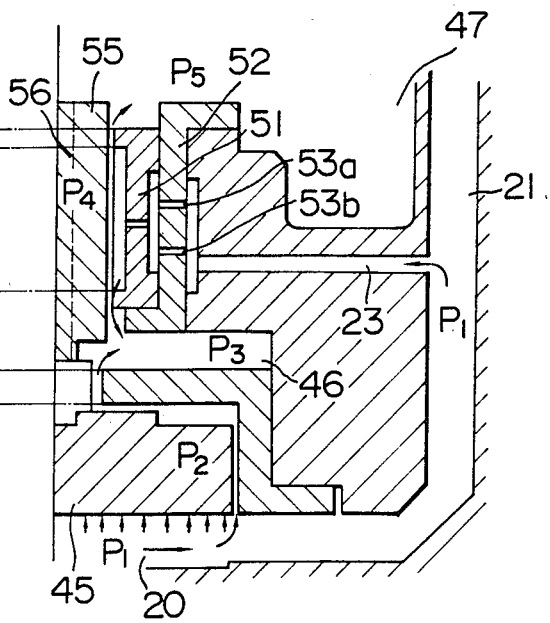
FIG. 3 is a sectional view of one-half portion of the hydrostatic lubricated bearing system used in the embodiment of the invention in FIG. 1.

As shown in FIG. 3, the hydrostatic lubricated bearing system 51 is formed with orifices 53*a* and 53*b* in the hydrostatic lubricated pocket 52 and the bearing case 54. Meanwhile the inner casing 2, supporting the bearing case 54, is formed with a duct 23 branching from a discharge passage 21 to lead a portion of a liquid to flow therefrom to the orifices 53*a* and 53*b*. Thus, the liquid flowing through the discharge passage 21 is partly introduced through the orifices 53*a* and 53*b* into the pocket portion of the hydrostatic lubricated pocket 52. A vertical duct 56 located inwardly of the rotary sleeve 55 maintains an intervening chamber 46, defined between a rotary ram 45 and the hydrostatic lubricated bearing system 51, in communication with a motor chamber 47 containing the stator 9 and the rotor 91. The ball bearing 4A includes an outer race section 41A having a slide bearing 42A arranged therein (see FIG. 1) to allow the ball bearing 4A to smoothly follow up the vertical movement of the rotary shaft 3. The slide bearing 42A which functions on the same principle as a radial bearing mounted at a lowermost end of a pump section is operative to introduce a portion of a pressurized liquid into a branch duct 24 to feed same to the slide bearing 42A having a hydrostatic lubricated pocket to cover the outer race section 41A with a film of pressurized liquid, to thereby minimize resistance offered to the sliding movement to allow the outer race section 41A to quickly follow up the vertical movement of the rotary shaft 3. This is conducive to the prevention of an occurrence of abnormal phenomenons in the ball bearing 4A (inordinate wear or seizure caused by unbalanced movement or lopsided loading).

Operation of the embodiment of the aforesaid constructional form will be described. As in the prior art, motor startup causes the impeller 6 to begin to rotate to supply a liquid on the suction side to the piping by pressurizing same. A portion of the pressurized liquid flows through a gap in the rotary ram 45 of the load reducing system while pushing the ram 45 upwardly. The discharge passage 21 has connected midway thereto the branch duct 23, and the hydrostatic lubricated bearing system 51 according to the invention for applying a radial load is mounted as a bearing at the lower end of the motor section. Thus, the pressurized liquid introduced into the branch duct 23 flows into the hydrostatic lubricated pocket 52 contained in the bearing case 54 of the hydrostatic lubricated bearing system 51, to apply a lubricating film of pressurized liquid to the pocket section to thereby support the rotary shaft 3 through the film of pressurized liquid.

The embodiment of the invention of the aforesaid constructional form offers the following advantages. In the case of equipment which is high in head, it is possible to withstand any radial thrust which might be applied to the bearing by a hydrodynamically unbalanced force exerted on the circumference of the inner chamber of the impeller housing because of the arrangement that the lower bearing on the motor side is constituted by the hydrostatic lubricated bearing system 51. The service life of the bearing is greatly prolonged when the hydrostatic lubricated bearing system 51 is used as compared with the service life of an ordinary ball bearing that would be used in a conventional arrangement. Additionally, any inordinate wear or seizure that might be caused by unbalanced movement or lopsided loading can be avoided.

The pressure acting in the vicinity of the hydrostatic lubricated bearing system 51 will now be discussed. The liquid pressurized at the impeller 6 enters a chamber 20 and the majority thereof flows into the discharge passage 21. However, a portion of the pressurized liquid pushes the rotary ram 45 upwardly at its boss surface as shown in FIG. 3 to develop an anti-thrust force Fa which can be expressed as $Fa=A(P_1-P_2)$ where A is the area of the boss of the rotary ram 45. The hydrostatic lubricated bearing system 51 admits a portion of the pressurized liquid from the discharge passage 21 through the branch duct 23 which is fed to the hydrostatic lubricated pocket 52 to provide a film of pressurized liquid. Thus, the liquid flowing out of the bearing surface is passed to opposite end faces of the bearing and then into the intervening chamber 46. When operation is started at this time, pressures from all quarters are sealed in the intervening chamber 46 and the pressure applied to the region extending from the chamber 20 to the hydrostatic lubricated pocket 52 becomes equal to a supply pressure $P_1$, as indicated by a pressure distribution shown in FIG. 2. If this situation occurs, there would be the risk that the rotary ram 45 and the hydrostatic lubricated bearing system 51 would cease to function as they are intended to, making it impossible for the hydrostatic lubricated bearing system to accomplish the object. To avoid this risk, the vertical duct 56 is provided in a plurality of numbers inwardly of the sleeve 55 to maintain the intervening chamber 46 in communication with the motor chamber 47 in which low pressure prevails. Thus, a rise in the pressure in the intervening chamber 46 is avoided to enable the hydrostatic lubricated bearing system 51 and the rotary ram 45 to properly function. When the vertical ducts 56 are provided, the pressure in the intervening chamber 46 drops as indicated by a broken line in FIG. 2, to enable an ideal pressure distribution to be obtained in various elements. This arrangement has the effect of the anti-thrust force Fa to be produced by the back pressure differential $(P_1-P_2)$ of the rotary ram 45 while giving rise to a radial reaction Fr in the hydrostatic lubricated bearing, so that a film of pressurized liquid is provided to the bearing surface to allow the rotary shaft 3 and the hydrostatic lubricated bearing system 51 to operate while being not in direct contact with each other. This eliminates the risk of wear being caused on the hydrostatic lubricated bearing system by metal-to-metal contact and makes it possible to operate the equipment stably over a prolonged period of time.

Figure 2:
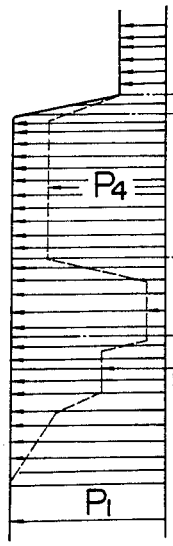
FIG. 2 is a diagrammatic representation of a pressure distribution in all the parts of the hydrostatic lubricated bearing system shown in FIG. 3.
Figure 4:
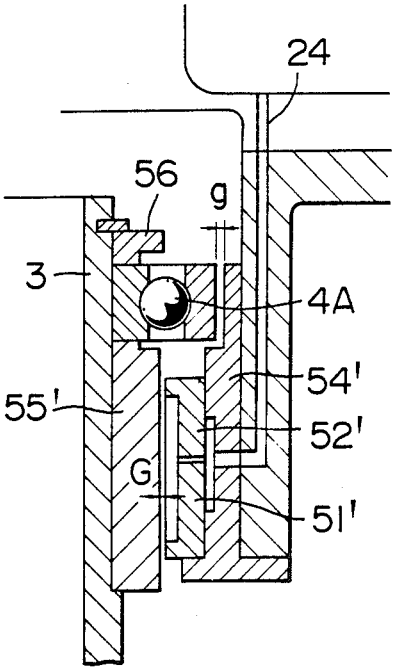
FIG. 4 is a schematic sectional view of another embodiment of the invention, showing the upper bearing on the motor side.

FIG. 4 shows another embodiment which is provided with a hydrostatic lubricated bearing system 51' of the same constructional form as that described by referring to the first embodiment shown in FIGS. 1–3. The system 51' is located immediately below a ball bearing 4A, and a lower bearing on the motor side is the same hydrostatic lubricated bearing system as described by referring to the embodiment shown in FIG. 1.

The reason why the ball bearing 4A and the hydrostatic lubricated bearing system 51' are used in combination as an upper bearing on the motor side in the embodiment shown in FIG. 4 is as follows. When a liquid much lower in viscosity than water is handled, it would be virtually impossible to bear the weight of a rotary member itself by a thrust bearing and a slide bearing when the equipment is started, so that the ball bearing 4A and the hydrostatic lubricated bearing system 51' are used in combination for bearing the weight. The feature of the embodiment shown in FIG. 4 is that a gap g between the outer race of the ball bearing 4A and the bearing case 54' is greater than a gap G between the hydrostatic lubricated pocket 52' and the rotary sleeve 55' of the hydrostatic lubricated bearing system 51' or $g>G$. By this feature, any radial thrust that might be produced during operation could be borne by the hydrostatic lubricated bearing system and would not be exerted on the ball bearing 4A. Meanwhile, the load reducing system cannot perform its function when the pump is inoperative because a discharge pressure of the pump is unavailable, so that the rotary shaft 3 would be moved downwardly by its own weight and journaled by the ball bearing 4A through a flange 56. As the pump is rendered operative, the rotary shaft 3 which is unitary with the rotary ram 45 would gradually move upwardly by virtue of a pumping pressure, to become balanced in a floating clearance C of the rotary ram 45 shown in FIG. 1. The rotary shaft 3 is moved by its own weight only for a short period when the pump is started and brought to a halt, and almost no load is applied to the ball bearing 4A during steadystate operation because a thrust load is kept from being applied thereto by the load reducing system and a radial thrust is borne by the hydrostatic lubricated bearing system 51' in the upper portion of the shaft 3. To estimate the possible service, assume that the working load P is reduced by half (maximum load at startup and stop), for example, from $L=K(C/P)^3$. Then it would follow that the service life could simply be increased eightfold. Under conditions of $C=4000$ kg and $P=100$ Kg (own weight), L would be over 500,000 hours. Thus, an unexpected prolongation of the service life could be achieved, and maintenance of the equipment would be facilitated because the need to perform maintenance could be almost eliminated.

In the embodiment described hereinabove and shown in FIG. 4, the ball bearing and the hydrostatic lubricated bearing system have been described as being used in combination only as an upper bearing on the motor side. It is to be understood, however, that the same combination may be used as a lower bearing on the motor side as well. Needless to say, other applications than those described herein may come to mind for the combination of a ball bearing and the hydrostatic lubricated bearing system 51'.

In the vertical motor pump according to the invention described hereinabove, at least one of the upper and lower bearings on the side of the motor for journaling the rotary shaft in the upper and lower portions of the rotor is constituted by a ball bearing, and the rotary shaft is journaled, besides being journaled by the ball bearing, by a hydrostatic lubricated bearing system for bearing a radial thrust during operation. By this arrangement, when a radial load is applied to the bearing, it is borne by the hydrostatic lubricated bearing system, so that the radial load can be satisfactorily borne. This is conducive to prolongation to a great extent of the service life of the bearing, and the bearing can be advantageously used with a vertical motor pump.

What is claimed is:

1. A vertical motor pump comprising:

a rotor fitted to a vertical rotary shaft;

a stator secured to a casing, said stator being located in predetermined spaced juxtaposed relation to said rotor;

an upper bearing and a lower bearing on respective sides of said rotor for rotatably journaling said rotary shaft at an upper portion and a lower portion respectively of said rotor;

an impeller secured to said rotary shaft in a position below said lower bearing, said impeller being operative to perform a pumping action as it rotates with the rotary shaft as a unit to discharge a liquid upwardly; and a load reducing system interposed between said impeller and said lower bearing, said load reducing system being operative to reduce a pump thrust generated when the motor pump is operated;

wherein one of said upper bearing and said lower bearing is constituted by a ball bearing, and a slide bearing is mounted on an outer periphery of a bearing case containing said ball bearing to allow said ball bearing to follow up the rotary shaft in vertical movement, and said rotary shaft is journaled, besides being journaled by said ball bearing, by a hydrostatic lubricated bearing system for bearing a radial load during operation.

2. A vertical motor pump as claimed in claim 1, wherein said hydrostatic lubricated bearing system and said load reducing system define therebetween an intervening chamber, and said stator and said rotor are housed in a motor chamber within said casing, said intervening chamber and said motor chamber being maintained in communication with each other via a vertical duct extending axially of a rotary sleeve mounted on said rotary shaft in a portion thereof supported by said hydrostatic bearing system, so as to keep a pressure in said intervening chamber and a pressure in said motor chamber in balance.

* * * * *